US007467419B2

(12) United States Patent
O'Neal et al.

(10) Patent No.: US 7,467,419 B2
(45) Date of Patent: Dec. 23, 2008

(54) RAPID EXTRACTION BODY HARNESS

(75) Inventors: David E. O'Neal, Akron, OH (US); Arthur L. Dobbins, Akron, OH (US)

(73) Assignee: North American Rescue Products, Inc., Greer, SC (US)

( * ) Notice: Subject to any disclaimer, the term of this patent is extended or adjusted under 35 U.S.C. 154(b) by 23 days.

(21) Appl. No.: 11/391,043

(22) Filed: Mar. 28, 2006

(65) Prior Publication Data

US 2006/0225189 A1 Oct. 12, 2006

Related U.S. Application Data

(60) Provisional application No. 60/667,651, filed on Apr. 4, 2005.

(51) Int. Cl.
*A41D 13/00* (2006.01)

(52) U.S. Cl. ..... 2/69

(58) Field of Classification Search ..... 2/69, 2/79, 81, 227, 94, 97, 69.5, 456, 310; 182/3–7; 244/151 R See application file for complete search history.

(56) References Cited

U.S. PATENT DOCUMENTS

| | | | | |
|---|---|---|---|---|
| 2,699,284 | A | 1/1955 | Rose | |
| 3,074,074 | A | 1/1963 | Lovering | |
| 4,854,418 | A * | 8/1989 | Hengstenberger et al. | 182/3 |
| 4,863,409 | A | 9/1989 | Johnson et al. | |
| 4,925,070 | A | 5/1990 | Tulgan | |
| 5,113,981 | A | 5/1992 | Lentz | |
| 5,388,551 | A | 2/1995 | Martusciello | |
| 5,435,272 | A | 7/1995 | Epstein | |
| 5,619,955 | A * | 4/1997 | Nelson | 119/857 |
| 5,787,500 | A * | 8/1998 | Lobello | 2/1 |
| 5,960,480 | A * | 10/1999 | Neustater et al. | 2/456 |
| 6,125,792 | A | 10/2000 | Gee | |
| 6,205,584 | B1 * | 3/2001 | Yocco | 2/69 |
| 6,256,789 | B1 * | 7/2001 | Young et al. | 2/69 |
| 6,305,024 | B1 * | 10/2001 | Schweer | 2/94 |
| 6,338,699 | B1 * | 1/2002 | Veitch | 482/69 |
| 6,637,547 | B1 * | 10/2003 | Wydner | 182/3 |
| 6,651,594 | B1 | 11/2003 | Bagwell | |
| 6,808,046 | B1 * | 10/2004 | Henson | 182/3 |
| 6,892,395 | B2 * | 5/2005 | Schweer | 2/94 |
| 6,968,809 | B2 * | 11/2005 | Reardon | 119/770 |
| 7,086,091 | B2 * | 8/2006 | Jordan | 2/69 |
| 2005/0211188 | A1 | 9/2005 | Grilliot et al. | |
| 2007/0044197 | A1 | 3/2007 | Turcotte et al. | |
| 2007/0084667 | A1 | 4/2007 | Waters et al. | |

* cited by examiner

*Primary Examiner*—Tejash Patel
(74) *Attorney, Agent, or Firm*—McNair Law Firm, P.A.

(57) ABSTRACT

A body harness comprising a waist strap for fastening around the torso of a user; a shoulder strap having a first distal end affixed to a right side of the waist strap and a second distal end affixed to a left side of the waist strap generally opposite from the first distal end; the shoulder strap extending upward from the waist strap in a looped arrangement for fastening over the front of the shoulders and behind the back of the neck of the user so that an apex of the shoulder strap is positioned generally behind the back of the neck of the user when worn; a back strap extending between the apex of the shoulder strap and the waist strap for supporting the back of the user when being dragged; and, a handle carried at the apex of the shoulder strap to facilitate dragging of the user.

16 Claims, 4 Drawing Sheets

Front View

Box-Stitch Closeup

Rear View

Shoulder Strap Closeup

Handle Closeup
(Ready Position)

Handle Closeup
(Deployed Position)

Buckle Locked

Buckle Unlocked

RAPID EXTRACTION BODY HARNESS

CROSS REFERENCE TO RELATED APPLICATIONS

The present invention claims the benefits of the filing date of U.S. Provisional Patent application Ser. No. 60/667,651, filed Apr. 4, 2005.

BACKGROUND OF THE INVENTION

1. Field of the Invention

The present invention relates to safety and rescue of downed or injured law enforcement, military or tactical operations personnel from a hostile environment.

2. Discussion of Related Art

Today, law enforcement and military personnel face more challenges than ever. The threat to personnel is at an all-time high. Rescuers working to remove downed or injured personnel also face many challenges. Traditional methods of removing downed or injured personnel require on average, three to four people. These methods are also time consuming and strenuous. They also put the rescuers themselves at risk by exposing them to the threat for longer periods of time. Accordingly, a need was realized for more efficient ways to remove downed or injured personnel. Thus, it is an object of the present invention to provide a rapid extraction body harness which not only reduces the number of people required to drag a person to safety, but also the amount of time and effort needed to do so.

SUMMARY OF THE INVENTION

The present invention, which is commonly referred to as the Draggin' Rescue Device (DRD) is designed to assist in the removal of injured Law Enforcement, Military or Tactical personnel from a hostile environment. The DRD greatly improves upon traditional methods. The DRD reduces the number of people required to carry out a rescue while speeding up the process at the same time.

The DRD is constructed of 1⅞" Seat Belt style webbing rated at 4,000 lbs. The DRD has a shoulder strap for each shoulder, a back strap, waist strap, and loop that extends out past the tactical vest of the wearer. All seams are sewn together with box-style stitching for added strength. The waist strap is connected with an ITW Nexus buckle. The DRD is designed to be worn under the tactical vest of Law Enforcement, Military or Tactical personnel. The DRD does not require modifications to tactical personnel equipment. The wearer puts the DRD on like a coat, snaps the quick-release buckle in the front, and adjusts the waist strap. The waist strap includes hook and loop connectors, such as Velcro® to secure excess waist strap webbing.

The DRD was the direct result of training with inferior methods. Traditional methods of removing downed or injured personnel from a hostile environment proved to be more strenuous, time consuming, and most importantly dangerous. In short, prior methods took more people, more time, and left the rescuer exposed to the threat of their own bodily harm for longer periods of time.

The DRD is lightweight, pliable, comfortable on the wearer, and requires no modifications to current gear worn by law enforcement or military personnel.

Using the DRD is very easy. It is donned like a coat on the outside of personal body armor. The tactical vest is then put on over top of the DRD. Testing has shown that the standard-size, adjustable DRD will fit most individuals. The wearer buckles the front and adjusts the waist strap. After extending the handle over the back of the tactical vest, the DRD is ready for use.

In the event that the wearer becomes injured or incapacitated, the DRD will assist in their removal to a safe place. Rescuers simply grab the handle on the wearer's back, slide their hand through and pull. The DRD will slide up the wearer and grab them in the area around the wearer's nipple line, just below the armpits. The DRD provides leverage to the rescuer, making it possible for as few as one person to move the victim. The rescuer can pull with one hand and provide protection for both he and the victim with the other, since he will not need to holster his weapon. Traditionally, this would be a three or four person operation, with two people carrying and one or two people providing cover. It is important to mention that the DRD is designed for horizontal evacuations only. The DRD is not designed, nor was there intent for the DRD to be used for vertical rescues.

DESCRIPTION OF THE PREFERRED EMBODIMENT

Figure 1:
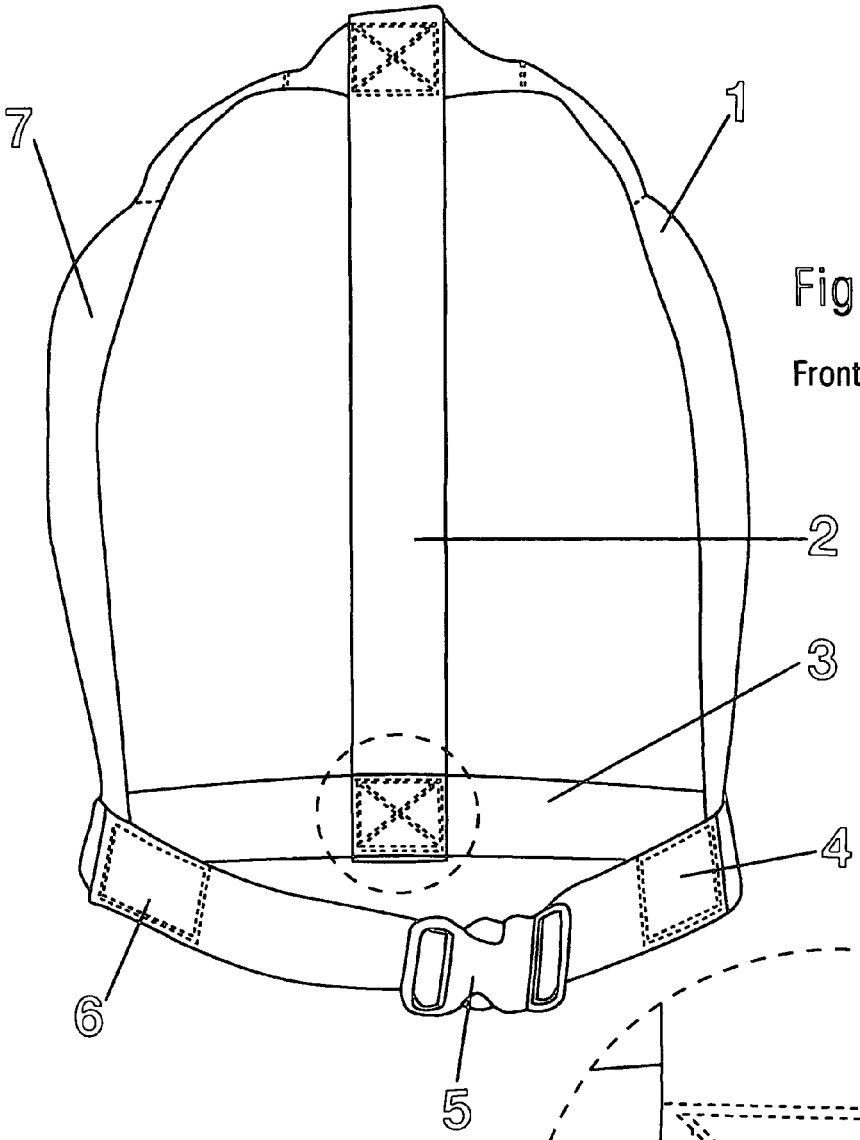
FIG. 1 is a front perspective view of the Draggin' Rescue Device (DRD)

The Draggin' Rescue Device (DRD) will be better understood when consideration is given to the following descriptions in correlation to the drawings provided:

FIG. 1 Front View #1 is the left shoulder strap and FIG. 1 Front View #7 is the right shoulder strap. The straps are actually made from one continuous piece of webbing that is attached at the bottom to the waist strap (FIG. 1 Front View #3) and at the top to the back strap (FIG. 1 Front View #2). The DRD is donned like a coat, which means there are two straps in the front (FIG. 1 Front View #1, 7) and one single strap that is located in the middle of the wearer's back (FIG. 1 Front View #2). The back strap (FIG. 1 Front View #2) of the DRD is connected at the bottom to the waist strap (FIG. 1 Front View #3) and at the top to the shoulder straps (FIG. 1 Front View #1, 7). On the waist strap you will find the buckle used to secure the DRD to the wearer (FIG. 1 Front View #5). Once the DRD is on the wearer and the waist straps are adjusted, the extra webbing is secured using hook and loop connection material carried by the waist strap (FIG. 1 Front View #4&6).

Figure 2:
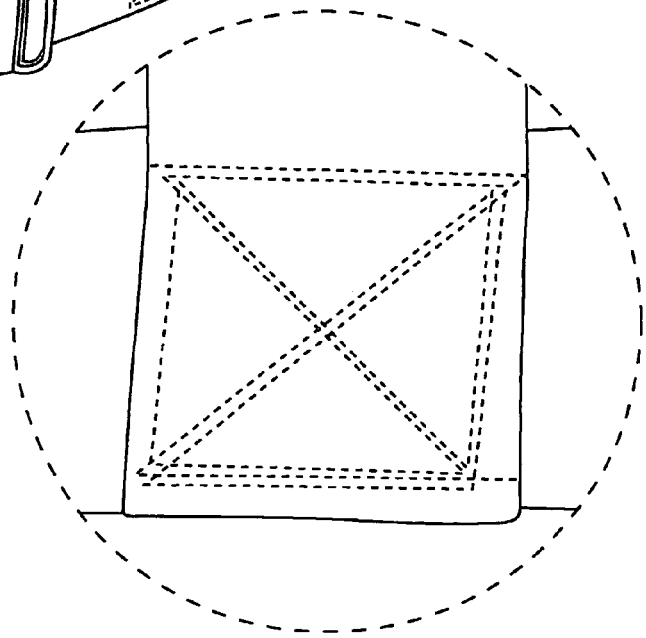
FIG. 2 is a close-up view of the Box-stitch that is used during the sewing of the DRD.

FIG. 2 Box-Stitch Close-up shows the box-stitch technique used to stitch all junctions of the shoulder, back and waist straps.

Figure 3:
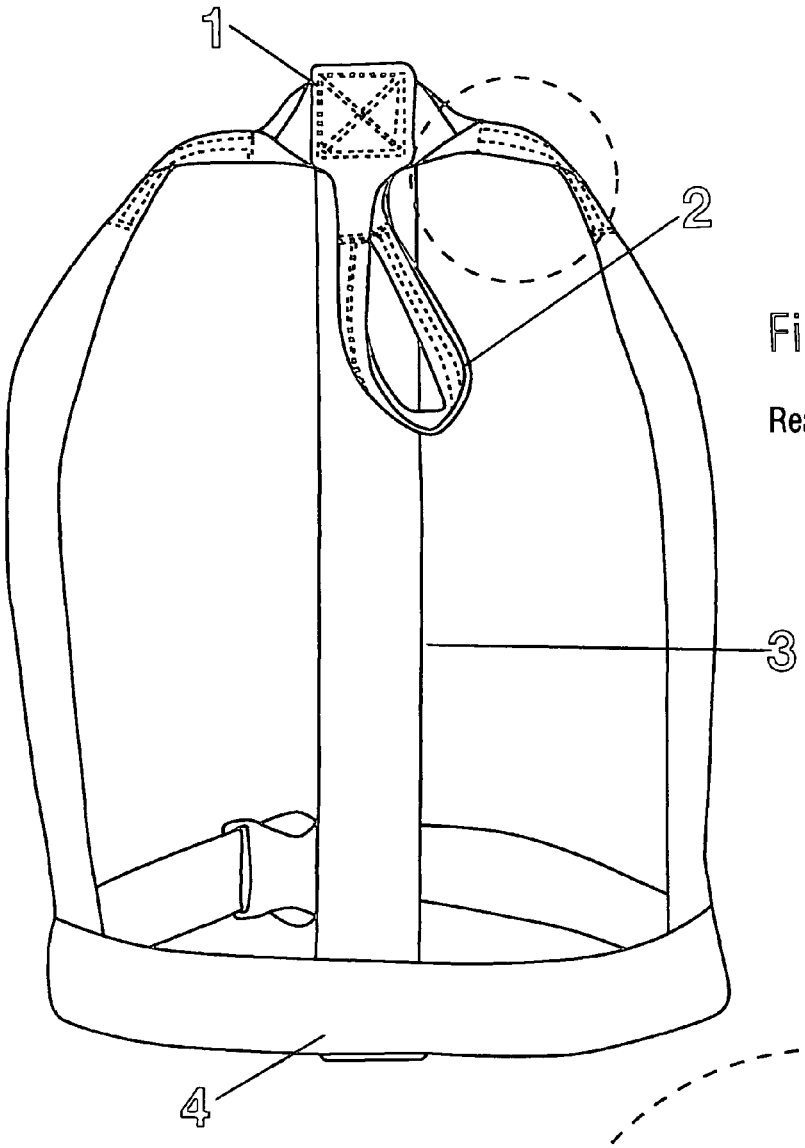
FIG. 3 is a rear view perspective of the DRD.
Figure 4:
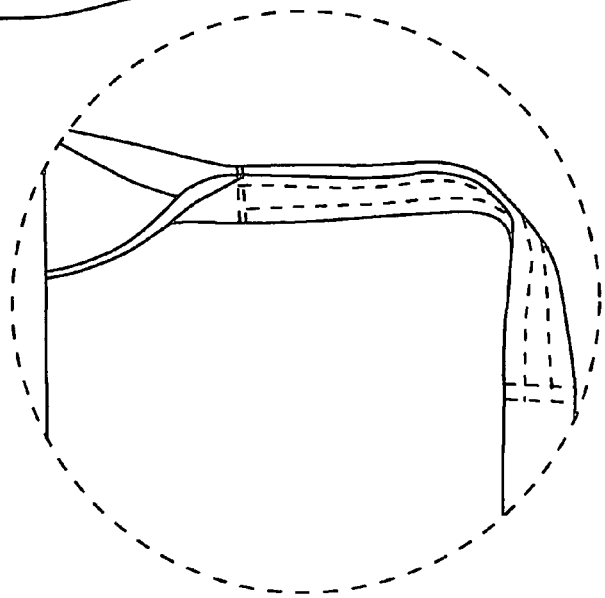
FIG. 4 is a close-up of the technique and stitching of the shoulder strap used to make the DRD.

FIG. 4 Shoulder Strap Close-up illustrates where the shoulder strap comes up near the wearer's neck. Each shoulder strap is folded in thirds, towards the middle of the webbing and then sewn down. This creates a narrowing around the neck area of the wearer preventing rubbing on the wearer's neck and providing added comfort. This narrowing also help the wearer distinguish the front of the DRD from the back (FIG. 3 Rear View).

FIG. 3 Rear View illustrates the handle of the DRD located at the top of the back strap (FIG. 3 Rear View #2). The handle is what the rescuer grabs when attempting to move the wearer using the DRD. In FIG. 3 Rear View #1, shows the box-stitch at the top of the handle. Located underneath this spot is hook and loop connection material that secures the handle in the ready position.

Figure 5:
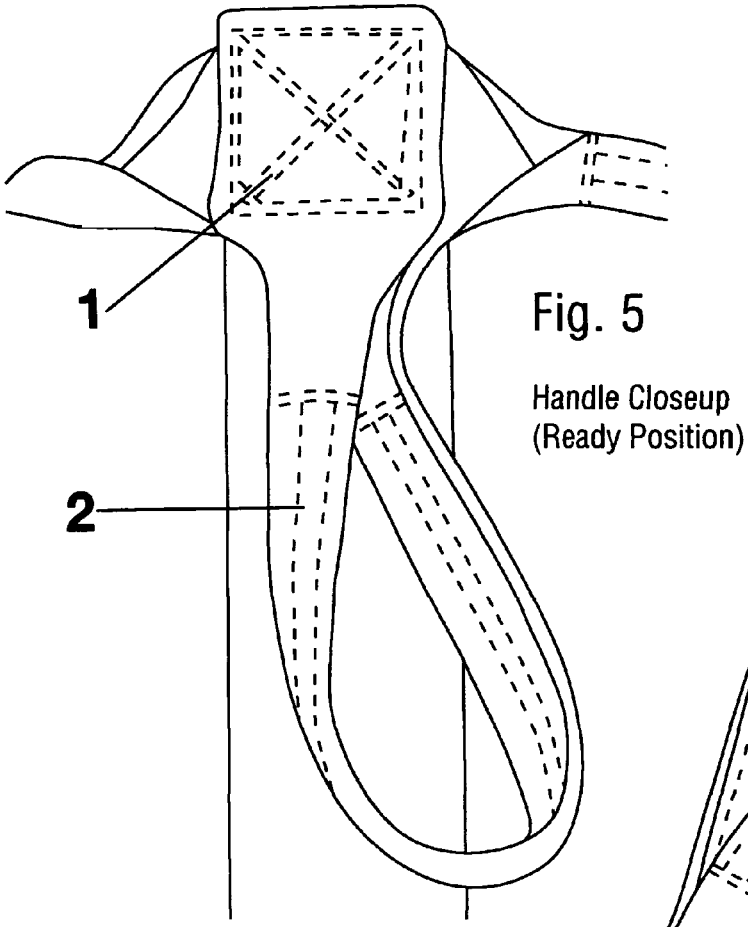
FIG. 5 is a close-up and detailed view of the handle and related components while in the ready position.
Figure 6:
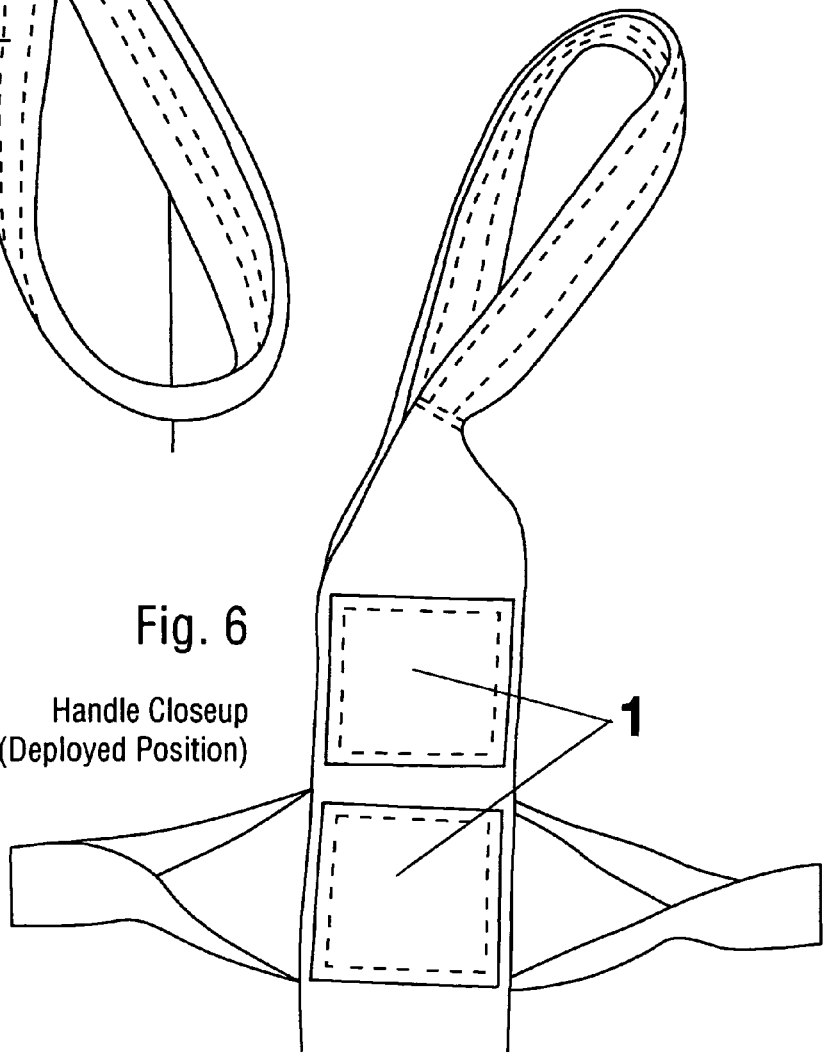
FIG. 6 is a close-up and detailed view of the handle while in the deployed position.

Close-up views of the handle are found in FIG. 5 Handle Close-up (Ready Position) and FIG. 6 Handle Close-up (Deployed Position). Notice in FIG. 5 Handle Close-up (Ready Position) #2 the stitching of the handle. Like the shoulder strap, it is folded in thirds and double stitched. The handle is sewn this way to help it maintain its shape while on the wearer, thus making it easier for the rescuer to grab. The two squares in FIG. 6 Handle Close-up (Deployed Position) #1 is a close-up of the hook and loop connection material that is used to hold the handle down and secured while in the ready position.

Figure 7:
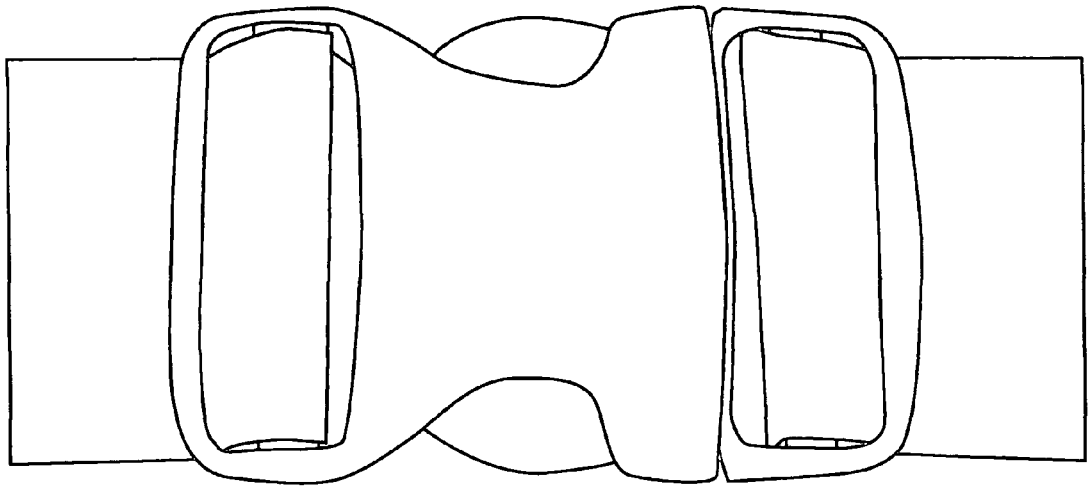
FIG. 7 is a view of the buckle in the locked position.

FIG. 7 Buckle Locked is a close-up of the buckle in the locked position. This is the position the buckle will be in when the DRD is being worn and ready for use.

Figure 8:
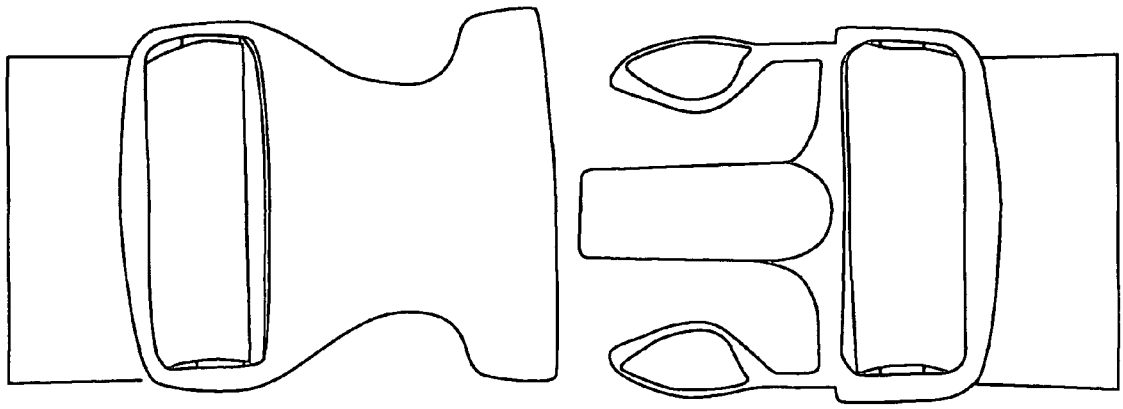
FIG. 8 is a view of the buckle in the unlocked position.

FIG. 8 Buckle Unlocked is a view of the buckle in the unlocked position.

What is claimed as being new and desired to be protected by Letters Patent of the U.S. is as follows:

1. A body harness for dragging a person from a hostile environment, said harness comprising:

a waist strap for fastening around the torso of a user;

a first shoulder strap having a first distal end fixedly carried by a right side of said waist strap;

a second shoulder strap having a first distal end fixedly carried by a left side of said waist strap generally opposite from said first shoulder strap;

said first shoulder strap and said second shoulder strap extending upward from said waist strap for fastening over the front of the shoulders of the user, and wherein said first shoulder strap is connected in a continuous single arching looped arrangement with said second shoulder strap so that an apex of said single arching looped arrangement is formed at the interconnection between said first shoulder strap and said second shoulder strap, and wherein said apex is positioned generally adjacent and behind the back of the neck of the user when worn;

a back strap independent of said first and second shoulder straps having a first distal end fixedly secured to said waist strap and a second distal end fixedly secured to said apex of said first and second shoulder straps for supporting the back of the user when being dragged; and, a handle carried by said back strap generally at said apex of said first and second shoulder straps to facilitate dragging of the user.

2. The body harness of claim 1 including a narrowed segment formed on each of said first and second shoulder straps for being disposed generally adjacent the neck of the user to reduce rubbing against the neck.

3. The body harness of claim 2 wherein said shoulder straps are each folded generally into thirds toward the middle of each said shoulder strap and secured together in an overlapping arrangement to provide said narrowed segment

4. The body harness of claim 1 wherein said handle is provided by looping said second distal end of said back strap onto itself and securing together generally at said apex of said shoulder straps.

5. The body harness of claim 4 wherein said handle includes folding said back strap into thirds toward the middle of said back strap and securing together in an overlapping arrangement.

6. The body harness of claim 1 including cooperating hook and loop connectors carried on said waist strap so that a first distal end and a second distal end of said waist strap are securable along the length of said waist strap to adjust the length of said waist strap.

7. A body harness for dragging a person from a hostile environment, said harness comprising:

a waist strap for fastening around the torso of a user;

a shoulder strap defining a single continuous arching loop having a first distal end affixed to a right side of said waist strap and a second distal end affixed to a left side of said waist strap generally opposite from said first distal end, wherein a midpoint apex of said shoulder strap is positioned generally adjacent and behind the back of the neck of the user when worn;

a back strap extending between said midpoint apex of said shoulder strap and said waist strap for supporting the back of the user when being dragged; and, a handle integrally formed at a distal end of said back strap generally adjacent said midpoint apex of said shoulder strap.

8. The body harness of claim 7 including at least one narrowed segment formed on said shoulder strap for being disposed generally adjacent the neck of the user to reduce rubbing against the neck.

9. The body harness of claim 8 wherein said narrowed segment is provided by folding said shoulder strap generally into thirds toward the middle of said shoulder strap and securing together in an overlapping arrangement.

10. The body harness of claim 7 wherein said handle is provided by looping said back strap onto itself and securing together generally at said apex of said shoulder strap.

11. The body harness of claim 10 wherein said handle includes folding said back strap into thirds toward the middle of said back strap and securing together in an overlapping arrangement.

12. The body harness of claim 7 including cooperating hook and loop connectors carried on said waist strap so that a first distal end and a second distal end of said waist strap are securable along the length of said waist strap to adjust the length of said waist strap.

13. A body harness comprising:

a waist strap;

a shoulder strap carried by said waist strap in a looping arrangement and having an apex disposed generally at a midpoint between a first distal end and a second distal end of said shoulder strap;

a back strap extending between said apex of said shoulder strap and said waist strap for supporting the back of the user when being dragged;

a pair of narrowed segments formed on said shoulder strap for being disposed generally adjacent opposite sides of the neck of the user to reduce rubbing against the neck, wherein said narrowed segments are provided by folding said shoulder strap generally into thirds toward the middle of said shoulder strap and securing together in an overlapping arrangement.

14. The body harness of claim 13 including a handle carried at said apex of said shoulder strap to facilitate dragging of the user.

15. The body harness of claim 14 wherein said handle has a stored position extending downwardly along said back strap for storage of said handle, and a deployed position extending above said apex to facilitate dragging of the user.

16. The body harness of claim 13 including cooperating hook and loop connectors carried on said waist strap so that a first distal end and a second distal end of said waist strap are securable along the length of said waist strap to adjust the length of said waist strap.

* * * * *